US012655720B2

(12) United States Patent
Vianna Ramos et al.

(10) Patent No.: US 12,655,720 B2
(45) Date of Patent: Jun. 16, 2026

(54) SUBSEA INDUCTION HEATING SYSTEM AND RELATED METHOD

(71) Applicant: FMC Technologies Do Brasil LTDA, Rio de Janeiro (BR)

(72) Inventors: Ricardo Vianna Ramos, Rio de Janeiro (BR); Ana Maria Guerreiro, Rio de Janeiro (BR); Mariana Ferreira Palacios, Niterói (BR); Anderson Moita Witka, Rio de Janeiro (BR); Victor Albuquerque, Rio de Janeiro (BR)

( * ) Notice: Subject to any disclaimer, the term of this patent is extended or adjusted under 35 U.S.C. 154(b) by 0 days.

(21) Appl. No.: 18/015,943

(22) PCT Filed: Jul. 13, 2021

(86) PCT No.: PCT/IB2021/056315

§ 371 (c)(1),
(2) Date: Jan. 12, 2023

(87) PCT Pub. No.: WO2022/013757

PCT Pub. Date: Jan. 20, 2022

(65) Prior Publication Data

US 2023/0265740 A1 Aug. 24, 2023

(30) Foreign Application Priority Data

Jul. 13, 2020 (WO) ..... PCT/IB2020/056551

(51) Int. Cl.

| | |
|---|---|
| ***E21B 36/00*** | (2006.01) |
| ***E21B 36/04*** | (2006.01) |
| ***E21B 41/00*** | (2006.01) |

(52) U.S. Cl.
CPC ..... *E21B 36/005* (2013.01); *E21B 36/04* (2013.01); *E21B 41/0007* (2013.01)

(58) Field of Classification Search
CPC ..... E21B 36/005; E21B 36/04; E21B 41/0007
See application file for complete search history.

(56) References Cited

U.S. PATENT DOCUMENTS

| | | | | |
|---|---|---|---|---|
| 6,278,095 | B1 | 8/2001 | Bass et al. | |
| 6,707,012 | B2 * | 3/2004 | Stone, Jr. | F16L 53/37 405/169 |
| 9,839,075 | B1 | 12/2017 | Sokryukin et al. | |
| 10,247,345 | B2 | 4/2019 | McCann | |
| 2011/0247825 | A1 * | 10/2011 | Batho | H02J 5/00 307/17 |
| 2013/0098625 | A1 | 4/2013 | Hickman | |
| 2015/0200609 | A1 * | 7/2015 | Hytten | H02M 7/70 219/488 |
| 2019/0003629 | A1 * | 1/2019 | Mccann | F16L 53/34 |
| 2019/0285219 | A1 | 9/2019 | Pionetti et al. | |
| 2019/0373677 | A1 * | 12/2019 | Perera | F16L 53/38 |

FOREIGN PATENT DOCUMENTS

| | | | | |
|---|---|---|---|---|
| WO | WO-2007055592 | A1 * | 5/2007 | F16L 53/34 |

* cited by examiner

*Primary Examiner* — Crystal J Lee

(57) ABSTRACT

A subsea induction heating system (10) comprising a subsea inline heater module (14) configured for heating a subsea hydrocarbon production or processing component (7) is described. The subsea inline heater module has an induction coil (6) configured for generating a variable magnetic field in the component. The system has a subsea variable frequency drive (4) configured for energizing the induction coil to achieve a desired temperature in the component. A corresponding method is also disclosed.

11 Claims, 1 Drawing Sheet

SUBSEA INDUCTION HEATING SYSTEM AND RELATED METHOD

FIELD OF THE INVENTION

The present invention relates to a subsea induction heating system and a related method.

BACKGROUND

In subsea hydrocarbon production or processing systems, flow assurance problems may arrise during operation or after shutdown of the system. There are many flow assurance problems that may occur when crude oil/gas flows in subsea equipment. The most common are wax deposition, emulsion formation, hydrate blockage, asphaltene precipitation, and inorganic scaling. Part of these problems can be minimized or eliminated by heating the production fluid and/or heating of the solid deposits.

Some crude oils become very viscous or deposit wax when the temperature of the fluid drops, causing significant decrease or stop of the oil production. One way to reduce the oil viscosity is to add heat to it. The fluid temperature will then increase, and the viscosity will reduce, facilitating flow and/or increasing hydrocarbon production. Wax deposit can thus be avoided by keeping the temperature of the production fluid above the wax formation temperature or, if wax has formed, wax can be dissolved by increasing the temperature.

Hydrocarbon gas combined with water at high pressure and low temperatures may form a solid called hydrate. Hydrate can plug equipment and lines and plugs are very difficult to remove. One method to remove hydrates is to increase the temperature in the local where a plug has formed in order to dissolve the plug.

A hydrocarbon production fluid will generally cool during transport in subsea pipelines and equipment until a topside processing unit is reached. The problem of low temperatures in subsea pipelines and equipment is normally addressed using thermal insulation. However, depending on the length of the pipelines, the fluid characteristics and operating conditions (pressure and temperature), thermal insulation alone may not be sufficiently effective. Also, there are equipment that cannot readily be insulated, e.g. due to the equipment having a complex geometry or because of the equipment's inherent function to cool the production fluid (e.g. subsea coolers).

Direct active heating (DAH) is a technology available in the oil and gas industry for subsea application. It is based on resistance heating, where an electric current is passed through an electric cable dimensioned in order to generate heat by Joule effect. Due to the generally long distances between the platform and the production well, where the heating system is used in pipeline sections, there may be losses and low efficiency in the use of electrical power when converted to generate heat. Thus, there is a potential limitation of the application of the existing technology due to the distance between the platform and the positioning of the heating system, depending on the power available on the platform and all the costs involved.

U.S. Pat. No. 10,247,345B2 discloses an apparatus for heating a portion of a subsea pipeline. The apparatus comprises at least one electrical conductor and a deployment mechanism which is configured to operatively support a length of the electrical conductor in a looped manner. The deployment mechanism is configured to deploy the looped conductor circumferentially about at least a portion of the pipeline. When the conductor is connected to a suitable power supply, the looped conductor is configured to operatively induce an alternating magnetic field within the portion of the pipeline in order to generate heat therein through induction heating.

The present disclosure is directed towards a system that may solve or reduce at least one of the aforementioned problems or challenges related to flow assurance.

SUMMARY OF THE INVENTION

The present disclosure relates to a system comprising an electromagnetic induction heating module (subsea inline heater-SIH) controlled by a subsea variable frequency drive (S-VFD). This heating system can be used for heating production fluid and/or dissociation of solid deposits, such as, hydrate and wax, that can be removed by increasing the temperature in the component or equipment which the production fluid is flowing. The SIH can be installed in pipes, coolers, valves or any other subsea equipment or component to be heated. The SIH will create an induced current in the equipment surface to generate heat that will be transferred to the production fluid and/or to solid deposits in the equipment.

The heating system may have a modular structure comprising: a S-VFD acting as a as power supply; an induction coil isolated from the external environment with a thermal insulation layer for heat conservation; a tubular section for the process fluid flow to be heated; a set of electrical connectors for power system and electrical connection between modules and process connections (input, output and intermediate). The heating system also include sensors for monitoring, control and system integrity.

The disclosed system may, depending on the implementation, provide the advantages of at least one of:

- reducing platform footprint (by allowing the power source to be moved to a subsea position);
- enabling the power source to be positioned near to the equipment and control system, thus reducing response time;
- achieving higher efficiency as compared to other prior art systems (Joule effect systems, thermal insulator); and
- increasing efficiency of separation systems and in transport of hydrocarbons and dissociation of solid deposits.

According to one example aspect, the present disclosure provides a subsea induction heating system comprising a subsea inline heater (SIH) module configured for heating a subsea hydrocarbon production or processing component, the subsea inline heater module comprising an induction coil configured for generating a variable magnetic field in the component. The system comprises a subsea variable frequency drive (S-VFD) configured for energizing the induction coil to achieve a desired temperature in the component.

The system may comprise a monitoring and control sub-system configured to monitor and control the temperature of the component and/or of a hydrocarbon production fluid flowing therein, and provide control signals to the subsea variable frequency drive to energize the induction coil to achieve said desired temperature in the component and/or in the production fluid.

The subsea variable frequency drive may comprise a rectifier configured for receiving an AC input current from a power source, an inverter configured for outputting an AC output current to the induction coil, and a DC link arranged between the rectifier and the inverter.

The subsea variable frequency drive may act as an AC-AC drive, converting an AC input to an AC inverter output.

The rectifier may be configured for receiving the AC input current from a topside platform.

The component may be a conduit configured for conveying a hydrocarbon production fluid.

The monitoring and control sub-system may comprise at least one sensor configured to monitor at least one of: temperature, pressure and/or flow of the process fluid flowing in the conduit; temperature on a surface of the conduit; temperature of the production fluid upstream and/or downstream of the subsea inline heater module.

The conduit may be a component in any one of: a pipe; a cooler; and a valve. The induction coil may be wound around the conduit.

The component may comprise a ferromagnetic material.

According to another example aspect, the present disclosure provides a method of heating a subsea component in a subsea hydrocarbon production or processing system, comprising the steps of:

heating the component using a subsea inline heater module comprising an induction coil configured for generating a variable magnetic field in the component; and energizing the induction coil to achieve a desired temperature in the component using a subsea variable frequency drive.

Above-discussed preferred and/or optional features of each aspect of the invention may be used, alone or in appropriate combination, in the other aspects of the invention.

DESCRIPTION OF THE DRAWINGS

Following drawings are appended to facilitate the understanding of the disclosure, wherein.

Figure 1:
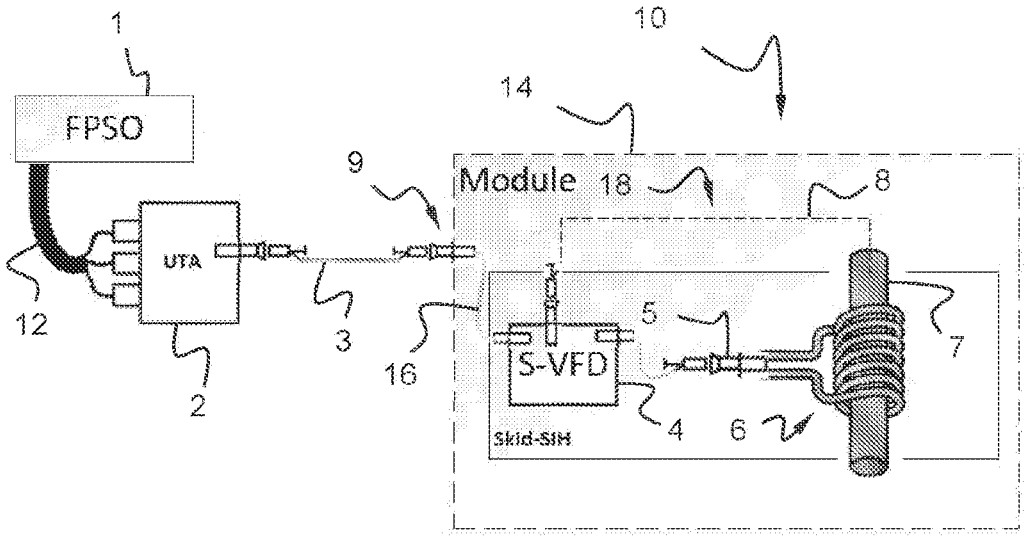
FIG. 1 schematically illustrates a subsea induction heating system.

It should be understood, however, that the drawings are not intended to limit the invention exclusively to the depicted subject-matter.

DETAILED DESCRIPTION OF THE INVENTION

In the following, embodiments of a subsea induction heating system will be described in more detail with reference to the drawings.

An induction heating system 10 is energized from a platform 1 via a power umbilical 12, arriving to an umbilical termination assembly (UTA) 2. An electrical flying lead (EFL) jumper 3 connects the UTA 2 to a subsea inline heater (SIH) module 14. The SIH module 14 can be installed on any type of subsea structure where heating of a pipe may be needed, for example on a pipeline end manifold (PLEM) and a pipeline end termination (PLET). An internal EFL 16 connects a panel connector 9 for a remotely operated vehicle (ROV) to an input penetrator of a subsea variable frequency drive (S-VFD) 4. The S-VFD 4 is configured to convert an input alternating current (usually 50 Hz or 60 Hz) into an alternating current of variable frequency. An output penetrator 5 connects the S-VFD 4 to an induction coil 6. The induction coil 6 surrounds a subsea pipe 7 to be heated.

Figure 2:
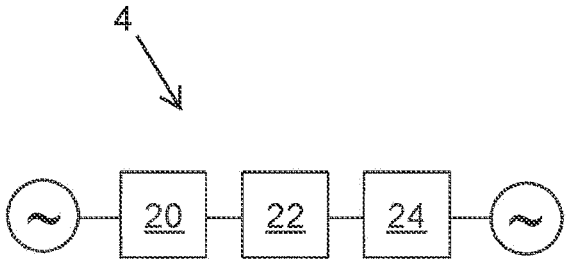
FIG. 2 schematically illustrates a subsea variable frequency drive in the system according to FIG. 1.

With reference to FIG. 2, the S-VFD 4 comprises a rectifier 20, a DC-link 22 and an inverter 24. The rectifier 20 comprises rectifier diodes (not shown), located in an input circuit of the S-VFD 4. The rectifier diodes are configured to rectify the AC voltage received from the platform 1. The resulting DC voltage is received by the DC-link 22 where it is filtered through a capacitor and used as an input to the inverter 24. In the inverter, the rectified DC voltage is again converted to AC voltage through switching using PWM technology.

The induction coil 6 generates a variable magnetic field, which changes direction according to the oscillating AC current outputted from the S-VFD 4. Preferably helical, the induction coil 6 comprises of a plurality of turns and is used to transfer energy generated by the S-VFD 4 to the pipe 7. The number of turns may be chosen based on the specific project design plan. The pipe section encircled by the coils may preferably be made of ferromagnetic material.

When the pipe 7 is subjected to the variable magnetic field produced by the current flowing in the coils, an alternating current is produced in the pipe by induction. This alternating current produces heat due to Joule effect losses in the pipe 7 (due to the resistivity of the pipe material). The heat will then be transferred to a fluid flowing in the pipe by thermal conduction.

The system 10 comprises a monitoring and control sub-system 18 configured to monitor and control the temperature of the production fluid flowing in the pipe 7. The sub-system 18 may comprise one or a plurality of sensors, e.g. sensors configured to monitor the temperature, the pressure and/or the flow of the process fluid flowing in the pipe 7, and/or sensors configured to monitor the temperature on the surface of the pipe 7. The number, type and position of the sensors are usually project dependent. However, the monitoring and control sub-system 18 may typically comprise sensors configured to monitor the temperature of the production fluid upstream and downstream of the SIH module 14. Signal data from the sensor or sensors may be transferred to the S-VFD 4 through an EFL jumper 8 to control the S-VFD. The pipe temperature may also be monitored to check and control the integrity of the material in the pipe 7.

In the preceding description, various aspects of the apparatus according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to person skilled in the art to which the disclosed subject-matter pertains, are deemed to lie within the scope of the present invention as defined by the following claims.

The invention claimed is:

1. A subsea induction heating system comprising:

a subsea inline heater module configured for heating a subsea hydrocarbon production or processing component, the subsea inline heater module comprising a modular structure which includes both an induction coil configured for generating a variable magnetic field in the component and a subsea variable frequency drive configured for energizing the induction coil to achieve a desired temperature in the component;

wherein the subsea inline heater module is configured to be energized from a topside platform via a power umbilical extending to an umbilical termination assembly; and wherein an electrical flying lead jumper connects the umbilical termination assembly to the subsea inline heater module.

2. The system according to claim 1, further comprising a monitoring and control sub-system configured to monitor and control the temperature of the component and provide control signals to the subsea variable frequency drive to energize the induction coil to achieve said desired temperature in the component.

3. The system according to claim 2, wherein the monitoring and control sub-system comprises at least one sensor configured to monitor at least one of: a temperature, a pressure and/or a flow of the process fluid flowing in the component; a temperature on a surface of the component; and a temperature of the production fluid upstream and/or downstream of the subsea inline heater module.

4. The system according to claim 1, wherein the subsea variable frequency drive comprises a rectifier configured for receiving an AC input current from a power source, an inverter configured for outputting an AC output current to the induction coil, and a DC link arranged between the rectifier and the inverter.

5. The system according to claim 4, wherein the rectifier is configured for receiving the AC input current from a topside platform.

6. The system according to claim 1, wherein the conduit is a component in any one of: a pipe; a cooler; and a valve.

7. The system according to claim 1, wherein the component is comprised of a ferromagnetic material.

8. The system according to claim 1, wherein the component is a conduit for conveying a hydrocarbon production fluid.

9. The system according to claim 8, wherein the induction coil is wound around the conduit.

10. A method of heating a subsea component in a subsea hydrocarbon production or processing system, the method comprising the steps of:

installing, on the component, a subsea inline heater module comprising a modular structure which includes both an induction coil configured for generating a variable magnetic field in the component and a subsea variable frequency drive configured for energizing the induction coil;

providing a power umbilical from a platform to an umbilical termination assembly;

providing an electrical flying lead connecting the umbilical termination assembly to the subsea inline heater module; and heating the component by energizing the induction coil using the subsea variable frequency drive to achieve a desired temperature in the component.

11. The method according to claim 10, wherein the step of providing the electrical flying lead connecting the umbilical termination assembly to the subsea inline heater module comprises connecting the electrical flying lead to a panel connector of the subsea inline heater module using a remotely operated vehicle.

* * * * *